US006338219B1

(12) United States Patent
Watson, Jr. et al.

(10) Patent No.: US 6,338,219 B1
(45) Date of Patent: Jan. 15, 2002

(54) BRACKET-INTEGRATED BACK-UP OPTICAL SIGHT

(75) Inventors: Fred W. Watson, Jr.; Charles F. Stevens, both of Montross; Vincent J. Vendetti, Fredericksburg; Michael M. Canaday, King George, all of VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/606,112

(22) Filed: Jun. 8, 2000

(51) Int. Cl.[7] ..... F41G 1/42
(52) U.S. Cl. ..... 42/130; 42/135; 42/136
(58) Field of Search ..... 42/100, 111, 119, 42/122, 140, 130, 124, 133, 134, 135, 137, 142, 143, 136

(56) References Cited

U.S. PATENT DOCUMENTS

| | | | | | |
|---|---|---|---|---|---|
| 370,344 | A | * | 9/1887 | Long | |
| 1,405,580 | A | * | 2/1922 | Green | |
| 1,774,053 | A | * | 8/1930 | Foster | |
| 4,017,995 | A | | 4/1977 | Hughes, Jr. | 42/1 S |
| 4,686,770 | A | * | 8/1987 | Aigner | |
| 4,841,659 | A | | 6/1989 | Williams | 42/101 |
| 4,993,158 | A | * | 2/1991 | Santiago | |
| 5,025,565 | A | * | 6/1991 | Stenerson et al. | |
| 5,134,798 | A | | 8/1992 | Lee | 42/100 |
| 5,533,292 | A | | 7/1996 | Swan | 42/100 |
| 5,659,965 | A | | 8/1997 | Thibodeau et al. | 33/261 |
| 5,806,228 | A | | 9/1998 | Martel et al. | 42/101 |
| 5,878,521 | A | | 3/1999 | Warnock | 42/103 |

* cited by examiner

*Primary Examiner*—Michael J. Carone
*Assistant Examiner*—Troy L. Chambers
(74) *Attorney, Agent, or Firm*—James B. Bechtel, Esq.; Peter J. Van Bergen, Esq.

(57) ABSTRACT

An optical sight is integrated into a bracket that can support an optical scope. The bracket defines a bore therethrough such that an optical line-of-sight is defined that is parallel to the line-of-sight of the optical scope. A post extends vertically upward into the bore at a forward end of the bracket in a way that the post's outboard end can be selectively positioned in the bore along a vertical line extending through the bore. A plate with a viewing aperture formed therethrough is mounted across the bore at an aft end of the bracket in a way that the viewing aperture can be selectively positioned along a horizontal line that is perpendicular to the vertical line defined by the post.

17 Claims, 2 Drawing Sheets

FIG.1
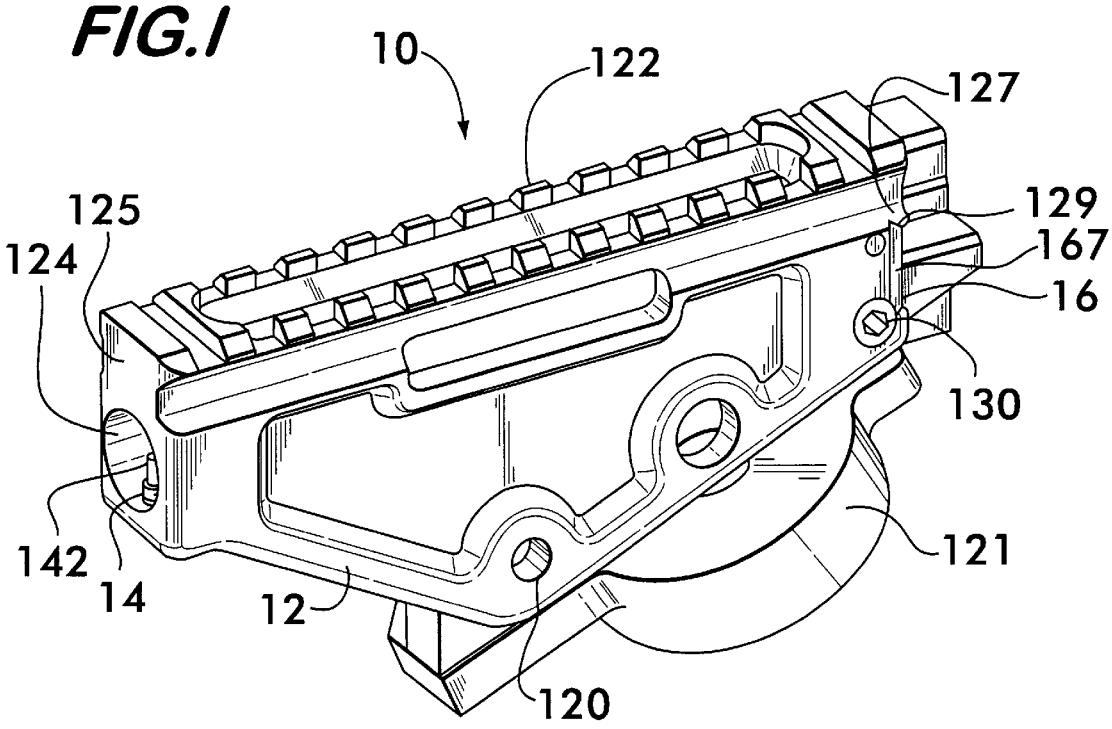
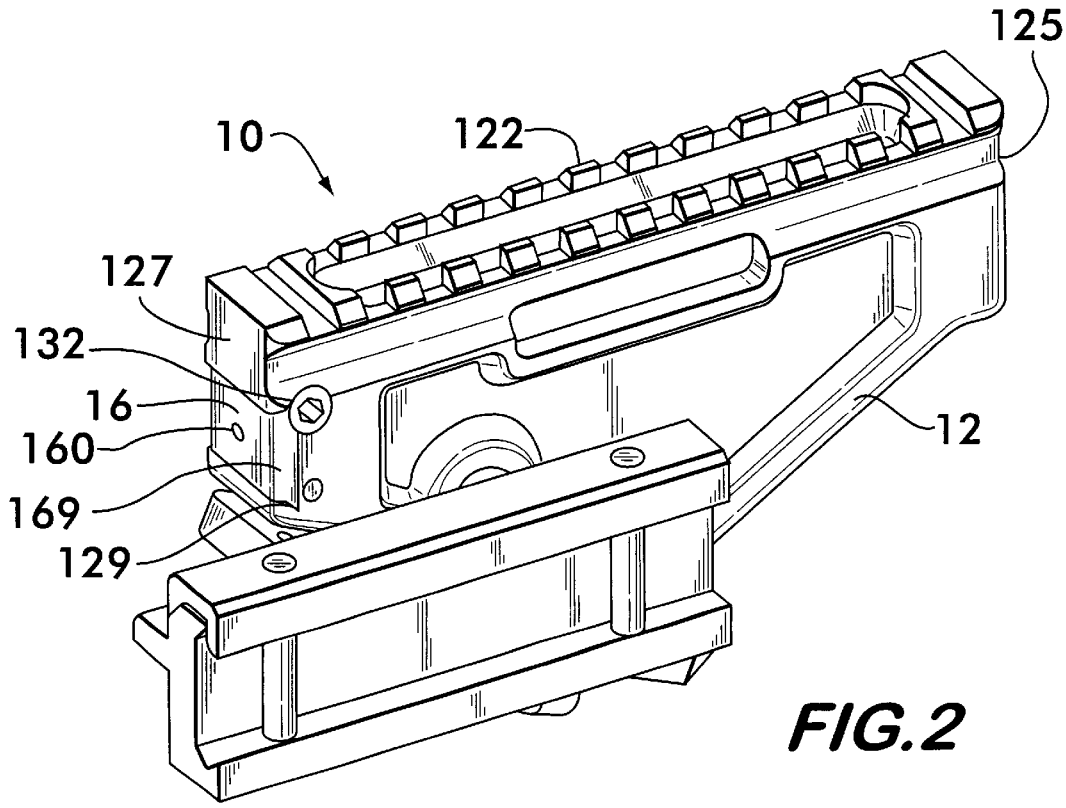
FIG.2

BRACKET-INTEGRATED BACK-UP OPTICAL SIGHT

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to optical sights, and more particularly to an optical sight that is integrated into an optical scope's mounting bracket to serve as a back-up optical sight.

BACKGROUND OF THE INVENTION

Optical scopes for weapons have become increasingly sophisticated as they make use of advanced optics and/or lasers. For ease of assembly and replacement in case of failure, the optical scope is typically mounted onto a bracket that is attached to a weapon. Unfortunately, a replacement optical scope may not be readily available in a field application. In such instances, the weapon may be useless unless the weapon is equipped with a back-up optical sight.

One type of back-up optical sight is described in U.S. Pat. No. 5,659,965. This back-up optical sight includes a peepsight and post that flip up adjacent to the weapon's optical scope. However, the peepsight and post can be easily damaged and add weight to the weapon.

SUMMARY OF THE INVENTION

Accordingly, it is an object of the present invention to provide a readily available back-up optical sight for a weapon.

Another object of the present invention is to provide a back-up optical sight for a weapon that is compact and rugged.

Still another object of the present invention is to provide a back-up optical sight for a weapon that is always aligned with the weapon's optical scope.

Yet another object of the present invention is to provide a back-up optical sight that does not add weight to a weapon.

Other objects and advantages of the present invention will become more obvious hereinafter in the specification and drawings.

In accordance with the present invention, an optical sight includes a base such as a bracket that can support an optical scope. The bracket defines a bore therethrough such that an optical line-of-sight is defined that is parallel to the line-of-sight of the optical scope that would be coupled to the bracket. A post is adjustably mounted in the bracket to extend vertically upward into the bore at a forward end of the bracket so that the post's outboard end can be selectively positioned in the bore along a vertical line extending through the bore. A plate having an aperture formed therethrough is adjustably mounted to the bracket across the bore at an aft end of the bracket in a way that the aperture can be selectively positioned along a horizontal line that is perpendicular to the vertical line defined by the post.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein:

FIG. 1 is a perspective view from the forward end of an embodiment of the bracket-integrated back-up optical sight according to the present invention;

FIG. 2 is a perspective view from the aft end of the bracket-integrated back-up optical sight;

DETAILED DESCRIPTION OF THE INVENTION

Figure 3:
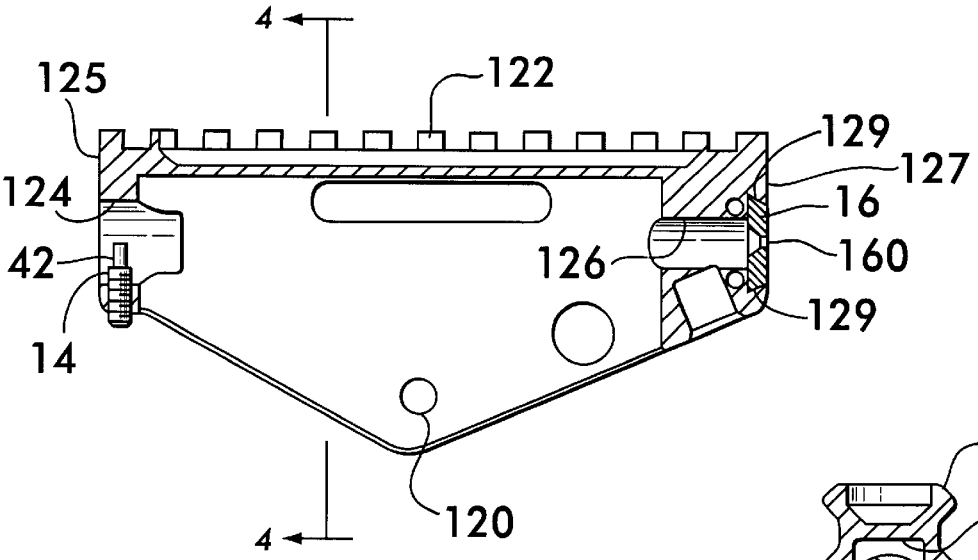
FIG. 3 is a cross-sectional view taken along the central longitudinal plane of the bracket-integrated back-up optical sight illustrated in FIG. 1.

Referring now to the drawings, and more particularly to FIGS. 1 and 2, a bracket-integrated back-up optical sight is illustrated in forward and aft perspective views, respectively, and is referenced generally by numeral 10. By way of illustrative example, back-up optical sight 10 is shown and will be described using an optical scope mounting bracket 12 for the United States Marine Corps' shoulder-launched multi-purpose assault weapon (SMAW). However, it is to be understood that the present invention could make use of other optical scope mounting brackets or any other part of a weapon or weapon accessory that is properly positioned to serve as a back-up optical sight and that can be modified as will be described herein.

As is known in the art, mounting bracket 12 is attached to a weapon using mounting hole 120. Once attached to the weapon, mounting bracket 12 can be rotated about mounting hole 120 to adjust the range of an optical scope (not shown) attached to mounting bracket 12. This range adjustment is provided by a range drum (not shown) cooperating with a range drum receiver 121 on mounting bracket 12. The optical scope is attached to a mounting rail 122, the design of which is not a limitation of the present invention. Once attached to mounting rail 122, the line-of-sight of the optical scope changes with the rotational movement of mounting bracket 12 in order to set the range of the weapon to which it is attached.

Figure 4:
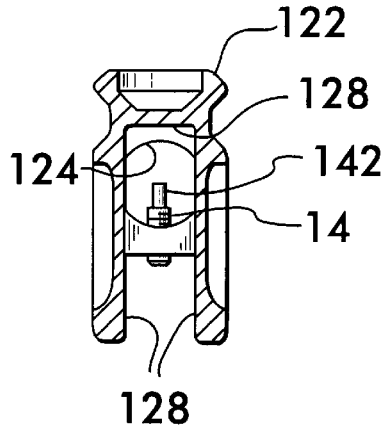
FIG. 4 is a cross-sectional view taken along line 4—4 in FIG. 3.

In accordance with the illustrated embodiment of the present invention, mounting bracket 12 is modified to provide a line-of-sight therethrough that is parallel to that of the line-of-sight of the optical scope that will be mounted thereto. For example, referring additionally to FIGS. 3 and 4, mounting bracket 12 can be configured or constructed to have a bore 124 at its forward end 125 and a bore 126 at its aft end 127 coupled to an internal slot 128 of mounting bracket 12. The combination of bore 124 at forward end 125, internal slot 128 and bore 126 at aft end 127, provide the necessary line-of-sight through mounting bracket 12. By integrating the line-of-sight in mounting bracket 12 and by making it parallel to the line-of-sight of the optical scope that attaches to mounting rail 122, range is simultaneously set for the optical scope and for the present invention's optical sight.

Figure 5:
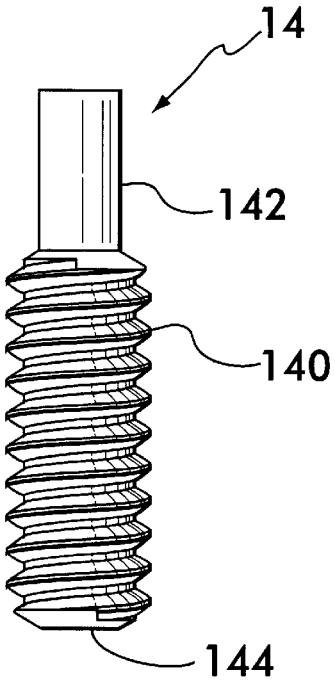
FIG. 5 is an enlarged isolated view of the post used in the forward portion of the bracket-integrated back-up optical sight.

Mounted in the bracket's line-of-sight is a post 14 (FIG. 1) serving as the forward portion of optical sight 10, and a plate 16 (FIG. 21, serving as the aft portion of optical sight 10. More specifically, post 14 includes a threaded portion 140 and a cylindrical portion 142 as best seen in FIG. 5. Threaded portion 140 is threaded into mounting bracket 12 such that cylindrical portion 142 extends vertically into bore 124. Threaded portion 140 has a head end 144 that is constructed (e.g., slotted, hex head, hex depression, etc.) to receive a screw/nut driver or hex head wrench so that cylindrical portion 142 can be raised/lowered in bore 124.

Figure 6:
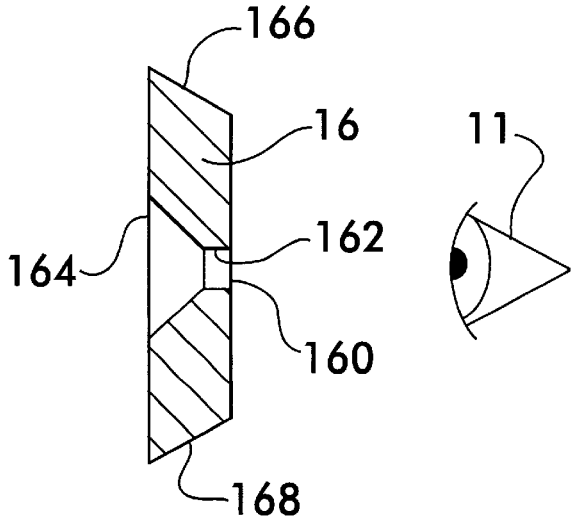
FIG. 6 is an enlarged cross-sectional view of the aperture plate used in the aft portion of the bracket-integrated back-up optical sight.

Plate 16 provides the user with a viewing aperture 160 at aft end 127 of mounting bracket 12. As illustrated in FIG. 6, viewing aperture 160 has a cylindrical portion 162 coupled to a conical portion 164. Cylindrical portion 162 is sized to set the correct aperture size for optical sight 10 as is known in the art. Conical portion 164 expands angularly away from cylindrical portion 162 to eliminate the "tunnel effect" as a viewer's eye 11 looks through cylindrical portion 162. At its top edge 166 and bottom edge 168, plate 16 is shaped to form a dovetail fit with a corresponding dove tail notch 129 cut in aft end 127.

Since it may be necessary to adjust the horizontal position of viewing aperture 160, plate 16 can slide horizontally in slot 129. That is, viewing aperture 160 can move along a horizontal line that is perpendicular to the vertical line defined by cylindrical portion 142 of post 14. To adjust and fix the horizontal position of plate 16, a variety of structures could be used. By way of example, screws 130 and 132 (e.g., hex head screws) are provided on either side of mounting bracket 12 as best seen in FIGS. 1 and 2, respectively. More specifically, each of screws 130 and 132 are threaded into mounting bracket 12 such that their longitudinal axes are parallel to the horizontal plane in which plate 16 can move, and such that their screw heads abut opposing side edges 167 and 169, respectively, of plate 16. To move plate 16 and viewing aperture 160 horizontally, one of screws 130 and 132 is backed out of mounting bracket 12 while the other is screwed into mounting bracket 12.

The advantages of the present invention are numerous. By integrating an optical sight into an optical scope's mounting bracket, a back-up optical sight is provided should the optical scope fail. Further, since the bracket-integrated optical sight is aligned with the optical scope that would be attached to the bracket, the ranging operation performed by moving the mounting bracket simultaneously performs the ranging operation for the back-up optical sight. The bracket-integrated back-up optical sight is rugged and compact since it is fully protected within the confines of the existing optical scope mounting bracket. In addition, inclusion of the bracket-integrated back-up optical sight actually makes the weapon lighter since material is removed (e.g., bored out) from the optical scope's mounting bracket.

Although the invention has been described relative to a specific embodiment thereof, there are numerous variations and modifications that will be readily apparent to those skilled in the art in light of the above teachings. For example, post 14 could be mounted in other ways to allow its vertical adjustment and plate 16 could be mounted in other ways to allow its horizontal adjustment. The present invention could be incorporated into any optical scope's mounting bracket provided there was room to do so. It is therefore to be understood that, within the scope of the appended claims, the invention may be practiced other than as specifically described.

What is claimed as new and desired to be secured by Letters Patent of the United States is:

1. An optical sight, comprising:

a base having a bore therethrough that defines an optical line-of-sight;

a post having an outboard end, said post being adjustably mounted in said base to extend vertically upward into said bore at a forward end of said base wherein said outboard end can be selectively positioned in said bore along a vertical line extending through said bore; and a plate having an aperture formed therethrough, said plate being adjustably mounted to said base across said bore at an aft end of said base wherein said aperture can be selectively positioned along a horizontal line that is perpendicular to said vertical line.

2. An optical sight as in claim 1 wherein said base is a mounting bracket capable of supporting an optical scope having a line-of-sight, and wherein said optical line-of-sight of said bore is parallel to the line-of-sight of the optical scope mounted on said mounting bracket.

3. An optical sight as in claim 1 wherein said post is threaded into said base.

4. An optical sight as in claim 1 wherein said plate is dovetailed to said base to allow said plate to move along said horizontal line.

5. An optical sight as in claim 1 wherein said aperture has a first portion through which a viewer sights and a second portion adjoining said first portion, and wherein said first portion is cylindrical and said second portion is a conical shape that expands away from the viewer.

6. An optical sight as in claim 1 further comprising means for adjusting position of said plate.

7. An optical sight as in claim 1 further comprising:

a first screw threaded into said base parallel to said horizontal line such that a head of said first screw abuts a first edge of said plate; and a second screw threaded into said base parallel to said horizontal line such that a head of said second screw abuts a second edge of said plate opposing said first edge.

8. An optical sight, comprising:

a bracket for supporting an optical scope having a line-of-sight, said bracket having a bore therethrough that defines an optical line-of-sight parallel to the line-of-sight of the optical scope;

a post having an outboard end, said post being adjustably mounted in said bracket to extend vertically upward into said bore at a forward end of said bracket wherein said outboard end can be selectively positioned in said bore along a vertical line extending through said bore; and a plate having an aperture formed therethrough, said plate being adjustably mounted to said bracket across said bore at an aft end of said bracket wherein said aperture can be selectively positioned along a horizontal line that is perpendicular to said vertical line.

9. An optical sight as in claim 8 wherein said post is threaded into said bracket.

10. An optical sight as in claim 8 wherein said plate is dovetailed to said bracket to allow said plate to move along said horizontal line.

11. An optical sight as in claim 8 wherein said aperture has a first portion through which a viewer sights and a second portion adjoining said first portion, and wherein said first portion is cylindrical and said second portion is a conical shape that expands away from the viewer.

12. An optical sight as in claim 10 further comprising means for adjusting position of said plate.

13. An optical sight as in claim 12 wherein said means for adjusting comprises:

a first-screw threaded into said bracket parallel to said horizontal line such that a head of said first screw abuts a first edge of said plate; and a second screw threaded into said bracket parallel to said horizontal line such that a head of said second screw abuts a second edge of said plate opposing said first edge.

14. An optical sight, comprising:

a bracket for supporting an optical scope having a line-of-sight, said bracket having a bore therethrough that defines an optical line-of-sight parallel to the line-of-sight of the optical scope;

a post having an outboard end, said post being threaded into said bracket to extend vertically upward into said bore at a forward end of said bracket wherein said outboard end can be selectively positioned in said bore along a vertical line extending through said bore; and a plate having an aperture formed therethrough, said plate being dovetailed to said bracket and extending across said bore at an aft end of said bracket wherein said aperture can be selectively positioned along a horizontal line that is perpendicular to said vertical line.

15. An optical sight as in claim 14 wherein said aperture has a first portion through which a viewer sights and a second portion adjoining said first portion, and wherein said first portion is cylindrical and said second portion is a conical shape that expands away from the viewer.

16. An optical sight as in claim 14 further comprising means for adjusting position of said plate.

17. An optical sight as in claim 16 wherein said means for adjusting comprises:

a first screw threaded into said bracket parallel to said horizontal line such that a head of said first screw abuts a first edge of said plate; and a second screw threaded into said bracket parallel to said horizontal line such that a head of said second screw abuts a second edge of said plate opposing said first edge.

* * * * *